US005979429A

United States Patent [19]

Schultheis et al.

[11] Patent Number: 5,979,429

[45] Date of Patent: Nov. 9, 1999

[54] MODULAR KITCHEN RANGE ARRANGEMENT UNDER A GLASS CERAMIC COOK-TOP

[75] Inventors: Bernd Schultheis, Schwabenheim; Michael Kahlke, Bingen-Sponsheim, both of Germany

[73] Assignee: Schott Glaswerke, Germany

[21] Appl. No.: 08/753,214

[22] Filed: Nov. 21, 1996

[30] Foreign Application Priority Data

Dec. 8, 1995 [DE] Germany ..... P 195 45 842

[51] Int. Cl.[6] ..... F24C 3/00

[52] U.S. Cl. ..... 126/39 G; 126/39 R; 126/39 F; 126/39 E

[58] Field of Search ..... 126/39 G, 39 R, 126/39 E, 39 J, 39 A, 39 K; 219/449

[56] References Cited

U.S. PATENT DOCUMENTS

| | | | |
|---|---|---|---|
| 3,624,352 | 11/1971 | Deaton | 219/449 |
| 3,740,513 | 6/1973 | Peters, Jr. et al. | 219/236 |
| 4,580,550 | 4/1986 | Kristen et al. | 126/39 J |
| 5,509,403 | 4/1996 | Kahlke et al. | 126/39 E |

FOREIGN PATENT DOCUMENTS

| | | | |
|---|---|---|---|
| 2436332 | 4/1980 | France . | |
| 2105969 | 8/1972 | Germany | H05B 3/76 |
| 3315745 | 10/1984 | Germany . | |
| 3409334 | 9/1985 | Germany . | |
| 2729930 | 3/1987 | Germany | H05B 3/74 |
| 4326945 | 2/1995 | Germany | F24C 15/10 |

OTHER PUBLICATIONS

351:Derwent WPI, DE 2729930 as above with Abstract in English, Radiation Heater for Glass Ceramic Cooker Hob–Has Insulating Ring with Rebate and Base Plate Holding Support Plate for Heating Element, Assignee: EGO Electro Blanc & Fischer (EGOE), Inventor: K. Fischer. Abstract of P 96116200.5 (German language).

*Primary Examiner*—Larry Jones
*Attorney, Agent, or Firm*—Fulbright & Jaworski, LLP

[57] ABSTRACT

Disclosed is a modularly constructed and variably configurable cook top arrangement of ready-made single modules each containing in a frame construction all parts necessary for operation as a burner module, exhaust component, blower unit, control module, signal and display unit, or other components, having a glass ceramic cook top in which the individual modules have shaped metal parts to which materials for thermal insulation are joined, and which have fastening means by which the modules can be arranged with one another and with the frame and can be fastened releasably to form a single functional unit, and on which openings, bores and recesses are provided as an assembling means for fastening the parts necessary for operation and for leading in and fixing the wiring and/or the ignition, control, and safety and indicating systems.

18 Claims, 6 Drawing Sheets

MODULAR KITCHEN RANGE ARRANGEMENT UNDER A GLASS CERAMIC COOK-TOP

BACKGROUND OF THE INVENTION

The subject of the present invention is a modular and variable kitchen range made up of ready-made single modules in a frame with a gas ceramic cook-top, wherein each of these individual modules comprises all parts necessary for operation as burners which can be fueled with any desired kind of energy source, or for operation as a gas exhaust unit, blower unit, control module, signal and display unit or parts necessary for other components.

Glass ceramic cook tops today consist usually of a metal view frame into which the glass ceramic cook surface is cemented, for example by means of silicone. Radiant heaters are pressed against the bottom of the cook surface by various resilient means. For this purpose, cross members and/or a bottom plate are necessary. Such a construction is extensively described in the patent literature. In the present state of the art, gas-heated cook tops with radiant burners under the glass ceramic are complex in construction. Such a system is described extensively, for example, in German Patent 43 26 945 A1.

In such gas ranges it is advantageous for burners, igniters, flame control electrodes and protective heat limiters to be integrated structurally into the thermal insulation, so that additional holes or openings must be provided in the thermal insulating material which cannot withstand much mechanical stress. In addition, other fastening means are necessary in the cook top. Shaping requires cost-intensive processing steps. However, such systems do not exhibit the flexibility regarding burner selection and arrangement of the kind known in electrically heated glass ceramic cook tops.

German DE-OS 2 105 969 discloses a cook top which has a frame structure, a pan-like bottom plate and electrically heated plates which correspond to cooking zones on the glass ceramic plate.

Also, in the cook top arrangement according to DE-OS 2 105 969, the heat elements lie on a thermal insulating material which is in the form of a block-like body and virtually fills up the space between the glass ceramic plate and the bottom plate.

From German Patent DE 27 29 930 C2 it is known to produce the thermal insulation for a plurality of heating elements in the form of an insulating body with key-shaped openings.

In the state of the art, shaping operations are required that are sometimes expensive. Also, installation in a sheet metal pan is almost always required to increase mechanical strength.

German Patent DE 33 15 745 C2 shows to a cook top with gas-fueled burners and with a continuous cooking surface of glass ceramic, having at least two definitely separate cooking zones each of which is associated with a separate burner, a warmer or keep-warm area and exhaust ducts for removing combustion gases, and auxiliary systems. The burners have gas mixing chambers, gas mixers and gas valves. The burner areas, the warmer zone and the exhaust ducts are surrounded at the areas which do not serve for the transfer of heat to the cook top, including all components of the burners, by a module common to these parts and consisting of thermal insulating material of low mass.

It is the object of patent DE 33 15 745 C2 to configure a gas cook top with a continuous cooking area of glass ceramic such that any undesired and disadvantageous heating of the pan space will be avoided, while allowing for a simple and low cost production of the cook top with little cost of assembly, and which will have a mechanically stable construction with good thermal insulation.

This design is still very difficult to adapt to different cook top layouts with sufficient flexibility, and the thermal insulating module common to all parts is very expensive to manufacture and difficult to handle. Further, its size and geometry make it costly to work with.

It is therefore an object of the present invention to provide a cook top system of variable layout, in which different types of burners, exhaust modules, blower units, control modules and other modules necessary for the operation of a cook top can be used in accord with requirements, even in different sizes and dimensions, and can be assembled and combined in a single functional unit in a minimum of time, in an existing, common frame construction, with a glass ceramic plate.

It is a further object of this invention is to provide a configuration of each component, including the necessary thermal insulation, such that it can be used even as a supporting module for additional modules and for additional components of apparatus, and simultaneously provide the often very delicate materials of the thermal insulation with strength and stability, and also provide protection against mechanical damage.

SUMMARY OF THE INVENTION

The above-stated objects are obtained by a versatile cook top system of modular design composed of pre-formed individual modules, wherein the modules have formed metal parts to which the thermal insulation materials are attached, and which have fastening means whereby the modules can be arranged in relation to one another and to the frame and fastened releasably to form a functional unit, and in which openings, bores and recesses are provided as means for fastening the parts necessary for operation, such as burners or exhaust components, and for the lead-through and the fixation of the wiring and/or ignition, control, safety and indicating systems.

At the same time, however, in accordance with the invention, several operating functions can be operatively combined in a single module, such as for example a burner, an exhaust module and a mixer.

In a preferred embodiment, the thermal insulation material is based on heat-resistant fibers, especially fibers of the system $SiO_2$—$Al_2O_3$. These materials are commercially available as needled mats (so-called "blankets") or as vacuum-formed parts of many different sizes and shapes, some of which are also pre-fired and freed of organic binders.

Since the processing, packaging and shape stability of ceramic fiber materials, however, due to their low raw density and low structural stability, are often not without problems, the materials installed for thermal insulation are also microporous materials of very finely divided or microporous bonded raw materials which, due to the manufacturing processes, such as by foaming or burn-out processes, have a fine porosity.

These microporous materials often can be made with good shape stability and tighter dimensional tolerances, but they are inferior to fiber materials due to their usually poorer insulating properties and higher weight.

In many cases, therefore, it may be useful to combine different thermal insulating materials in a single module, in accordance with the profile of the requirements of the material.

The materials for the thermal insulation can be firmly anchored and bonded to the metal parts of the individual modules mechanically by a press fit and additionally anchored and affixed by means of bendable tabs or straps.

In another embodiment of the invention, the insulating material, which has previously been appropriately shaped, is cemented to the metal part, for example a sheet-metal pan.

Suitable cements are primarily ceramic cements which are thermally stable and provide a sufficiently good surface adhesion to the insulating material and to the metal. Such adhesives are known on the market.

In another and especially preferred embodiment, the thermal insulation, which consists of bonded solid ceramic fiber material, is bonded continuously to the metal part of the individual module according to the invention, in which case the part is configured as a sieve mesh in a supporting permanent sieve form for the insulating layer that is to be produced by the vacuum process.

A slotted or perforated sheet metal plate is preferred as the mesh for the sieve form to give the form sufficient great stability and while providing the means for connection to other components.

A simple method, which is suitable for series manufacture, for producing a module of this kind according to the invention, is characterized by the fact that the metal sieve mesh is shaped mantle-wise to the contour of a component of the cook top arrangement, e.g., a pan; that the metal sieve mesh serving as the mantle is used as a mold for ceramic fibers deposited from a liquid preparation on its inside surface by a suction process, and that additional layers can be deposited over the dried and solidified layer of the fiber material, if desired, especially elastic fiber materials.

It is advantageous that the metal sieve mesh serves as a mold for the suction process, in which the liquid of the preparation is drawn off through the holes or slits, so that the fibers are deposited continuously by bonding to the metal mold.

A similar manner of procedure for a heating gas guiding module is found in German Patent DE 35 34 757 C2.

According to the present invention, the individual modules, and after their assembly to a functional unit, have a symmetrical geometric shape in order on the one hand to facilitate the assembly of a plurality of modules by having a maximum number of common contact areas and thereby stabilizing the unit, and on the other hand, to achieve the greatest possible filling of the space within the given frame.

The various features of novelty which characterize the invention are pointed out with particularity in the claims annexed to and forming a part of this specification. For a better understanding of the invention, its operating advantages, and specific objects obtained by its use, reference should be made to the accompanying drawings and descriptive matter in which there is illustrated and described a preferred embodiment of the invention.

DESCRIPTION OF PREFERRED EMBODIMENT

Figure 1:
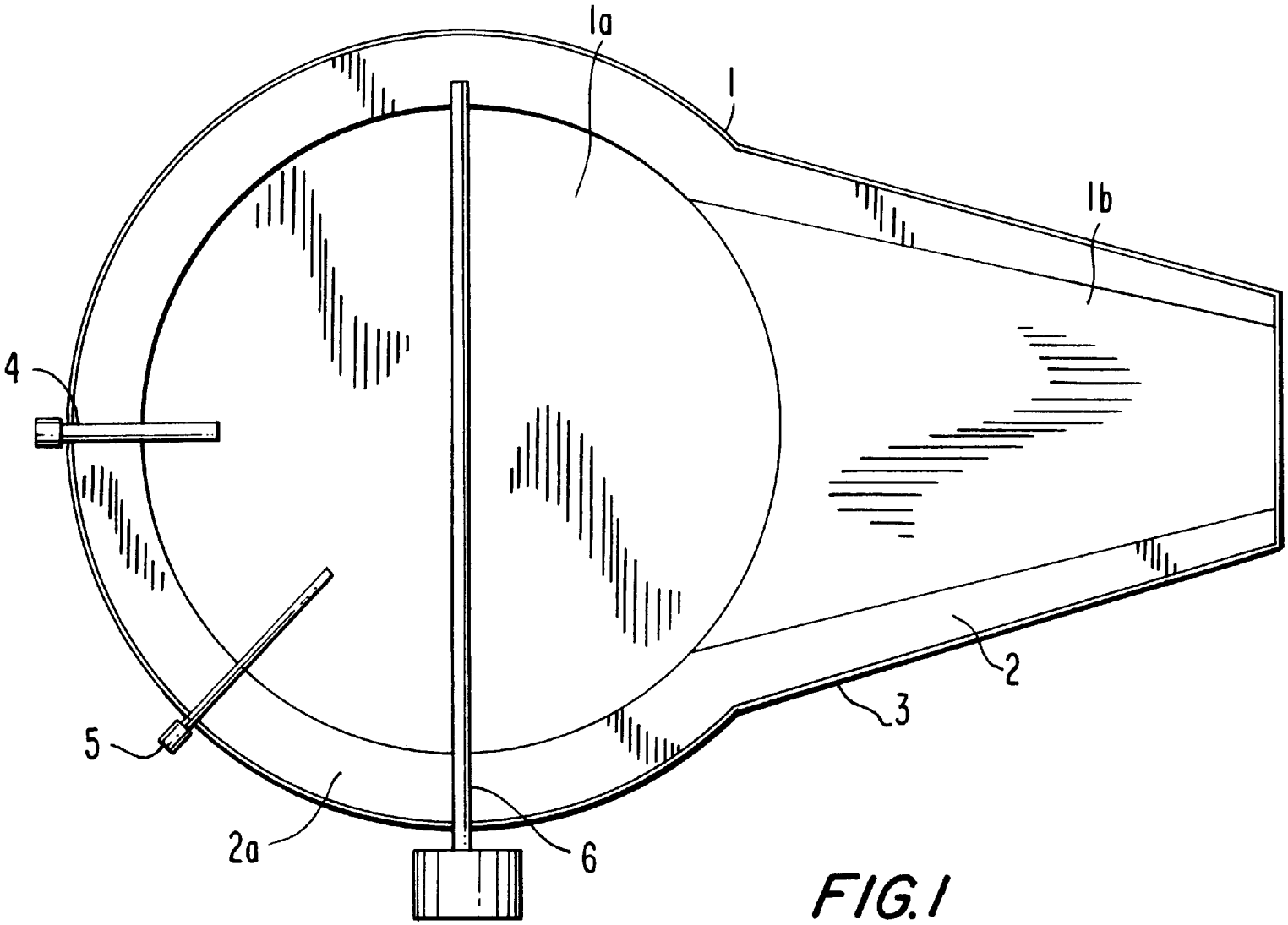
FIGS. 1 and 2 represent, in plan view, a gas burner module as a single module.

Referring to the drawings, FIG. 1 shows in plan a gas burner module 1 as a single component. The burner module has a circular combustion chamber 1*a,* and an exhaust duct 1*b.* In this embodiment the exhaust duct is of a tapered shape. The thermal insulating material 2 has previously been molded into the metal piece which, in this embodiment, is a sheet-metal housing 3. The igniter 4, a glowing-wire igniter in this instance, the ignition safety system 5, which is an ionization detecting electrode, and the temperature limiter 6, an expanding rod switch as already in use in electrical radiant heater elements in glass ceramic cook tops, are bolted to the sheet metal housing 3. Not shown in this figure is the burner housing 7, fastened from underneath, with the burner plate 15, the mixer tube 8 and the magnetic valve 9 with the gas jet 9*a.*

The dimensions of the burner module 1 depend on the size of the heated area (corresponds to the dimensions of the burner area 1*a*) plus the margin of insulating material 2*a* which should have a minimum width of 10 mm, so that a sufficient lateral heat blocking effect is assured. A wall thickness of 15 to 20 mm has proven advantageous. Cook areas having diameters of 145 mm, 180 mm and 210 mm are commonly desired. Moreover, oval or rectangular cook areas can also be made in the manner described above.

The end of the exhaust duct 1*b* is represented in a preferred form, such that the cross section in all such burner modules is the same, making it easier to combine them with one another.

Figure 2:
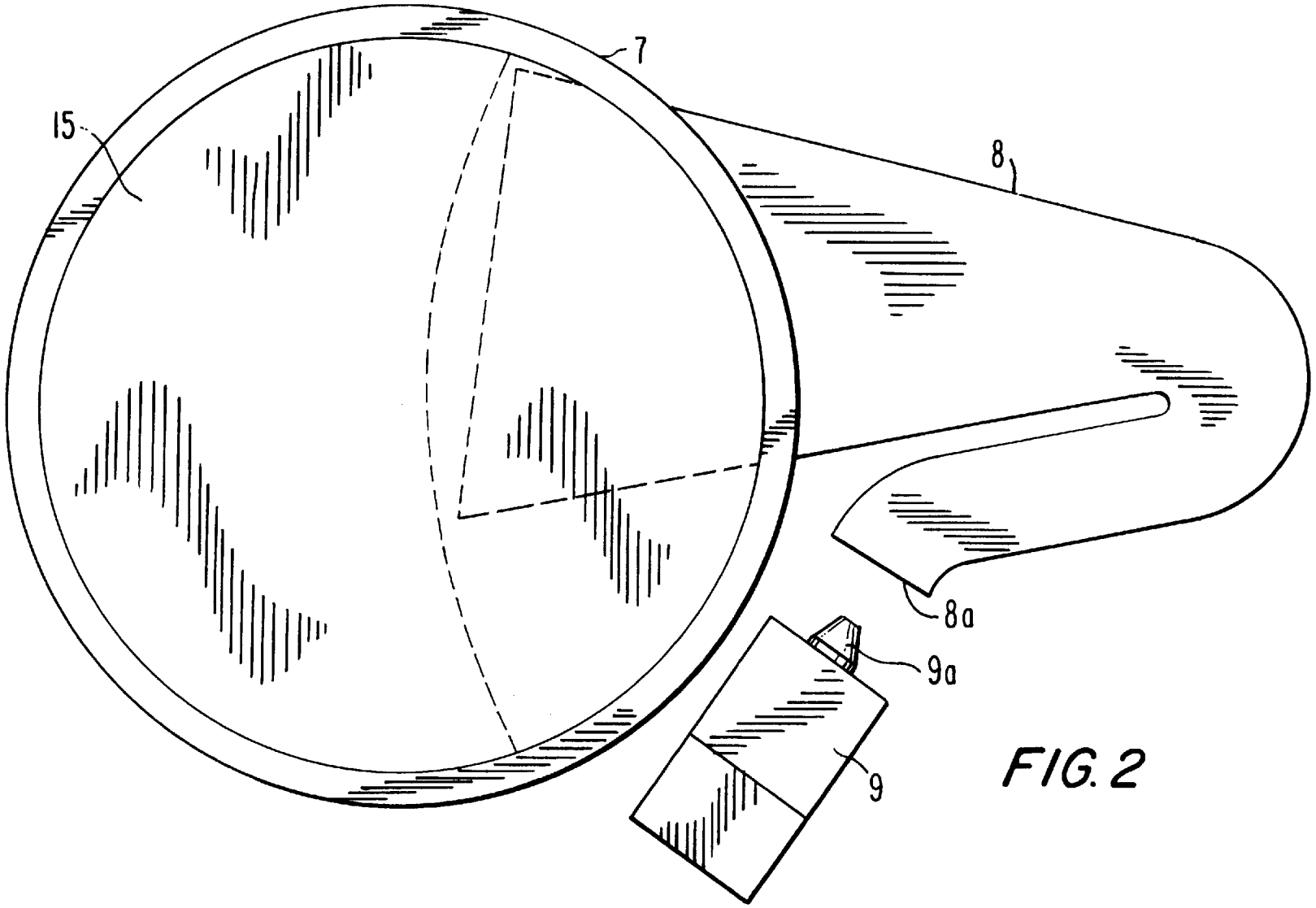

FIG. 2 shows in plan view the burner housing 7 with the burner plate 15 and the mixer tube 8, which is usually preinstalled on the sheet-metal housing 3 from underneath. A magnetic valve 9 with the gas jet 9*a,* which is likewise pre-installed separately on the sheet-metal housing 3, is shown.

In a preferred embodiment, the mixer tube 8 is formed in a converging shape as represented to provide an especially compact configuration of the burner module 1. A basic design consideration is that a sufficiently good mixing of the gas with the air entering at the air inlet 8*a* is obtained. For this several possibilities exist such as a folded mixer tube (as represented in FIG. 2) or additional corrugations (alternating if desired) in the mixer tube, or turbulence-creating inserts, such as perforated plates, in the mixer tube.

Figure 3:
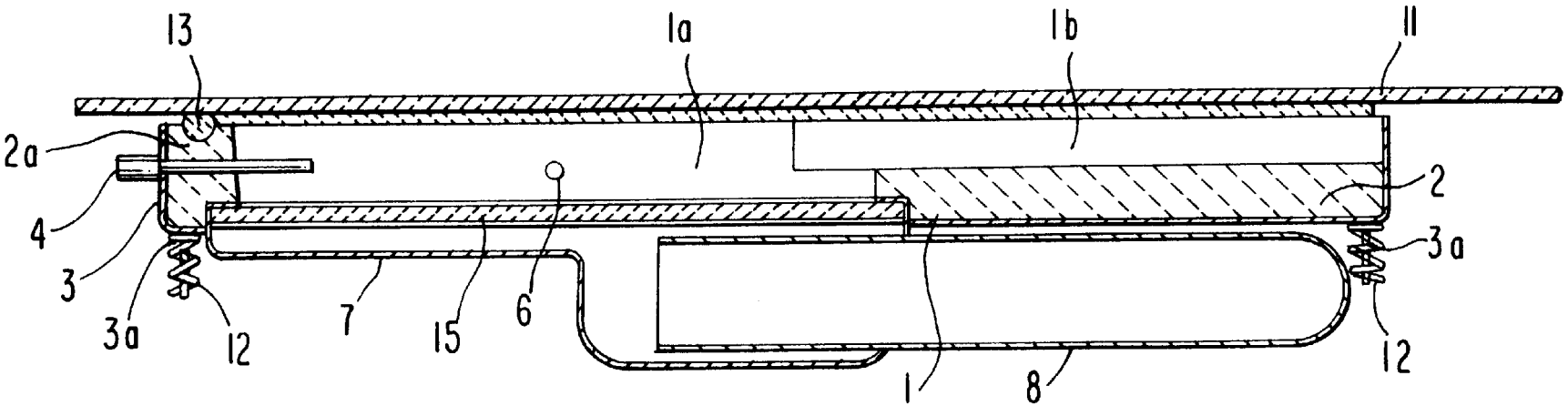
FIG. 3 depicts, in section, a gas burner module as a single module.

FIG. 3 schematically illustrates, in section, the burner module 1 and the burner housing 7 being pre-installed on the sheet-metal housing 3. The burner module 1 is urged against the glass ceramic cook surface 11 by springs 12. Lugs 3*a* are already provided on the housing 3 to secure the springs. A cord gasket 13 of heat-resistant material, which is inserted into a groove running about the periphery of the burner chamber 1*a* and the exhaust duct 1*b,* prevents, on the one hand, direct contact with the commonly burnt, relatively hard thermal insulating material 2 with the glass ceramic cook area 11, and on the other hand, seals the burner chamber 1*a* from the cold part of the cook top to inhibit the escape of exhaust gases at this point.

Figure 4:
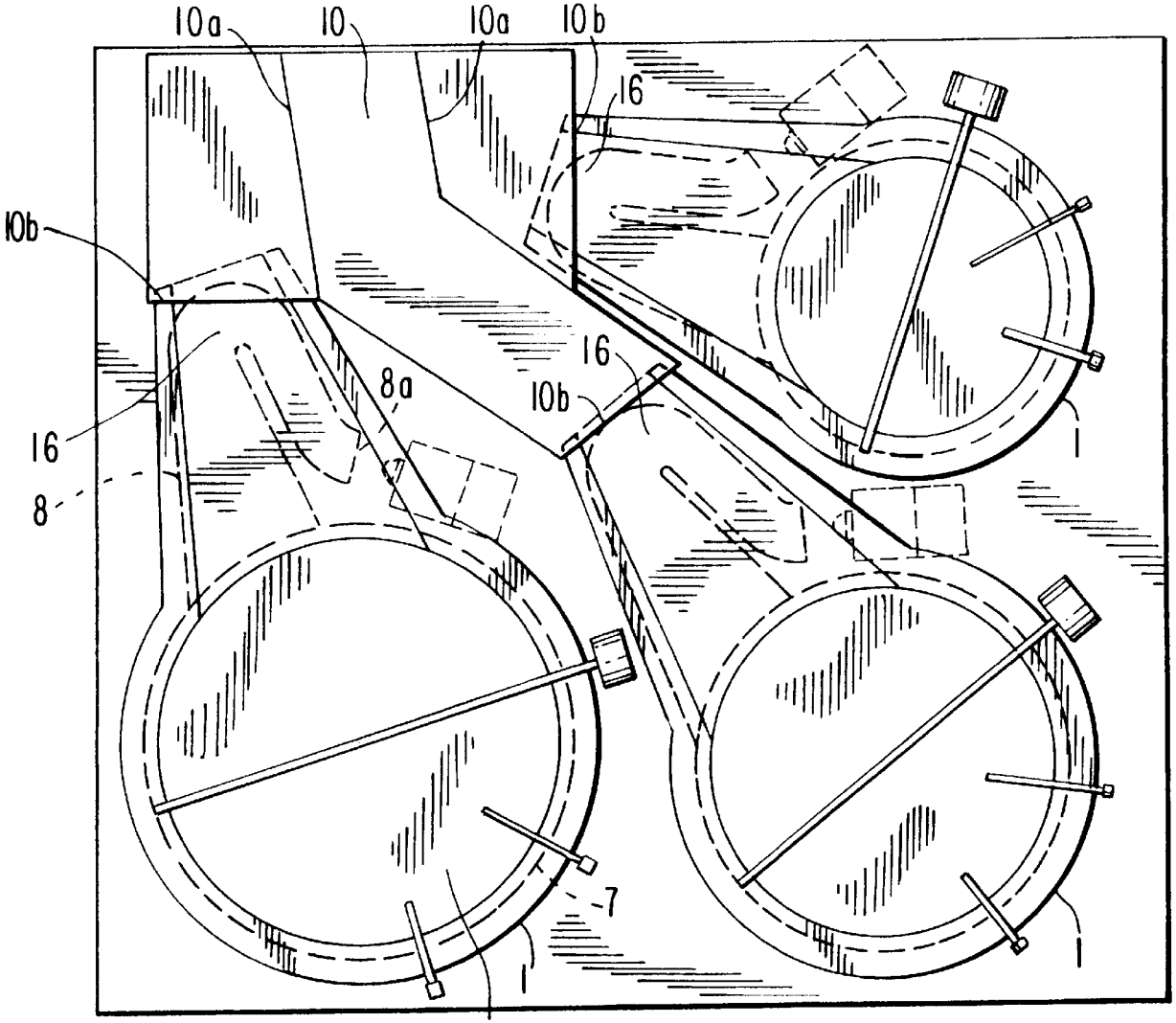
FIG. 4 illustrates a gas-heated cook top arrangement with three burner modules and one exhaust component as single modules forming one functional unit.

FIG. 4 shows in schematic a top plan view of a gas cook top with three burner modules 1, each having a different burner surface diameter. The exhaust ducts 1*b* discharge together in an exhaust duct component 10. In order to assure a controlled flow, sheet-metal baffles 10*a* are provided in this exhaust duct component 10 and are sealed against the bottom of the glass ceramic cook surface 11 by a permanently elastic, heat-resistant material, for example sealing cords. Interference between the individual burners is largely prevented by the baffles. Furthermore, the openings 10*b* in the exhaust gas component 19 for the exhaust ducts 1*b* of the burner module 1 are of such dimensions that air can enter laterally. In this manner a pre-cooling of the hot exhaust gases is achieved. The pressure required for that purpose in the cook top housing is produced by a blower not shown here. In determining the size of the openings 10*b* care must be taken that sufficient air pressure is available at the air inlet 8*a* of the mixer tubes 8, so that the resistance to flow of the burner plate 15 in the burner housing 7 is overcome. The exhaust manifold 10 consists, like the burner module 1, of a thermal insulation material shaped into a sheet-metal housing in the manner described above.

Figure 5:
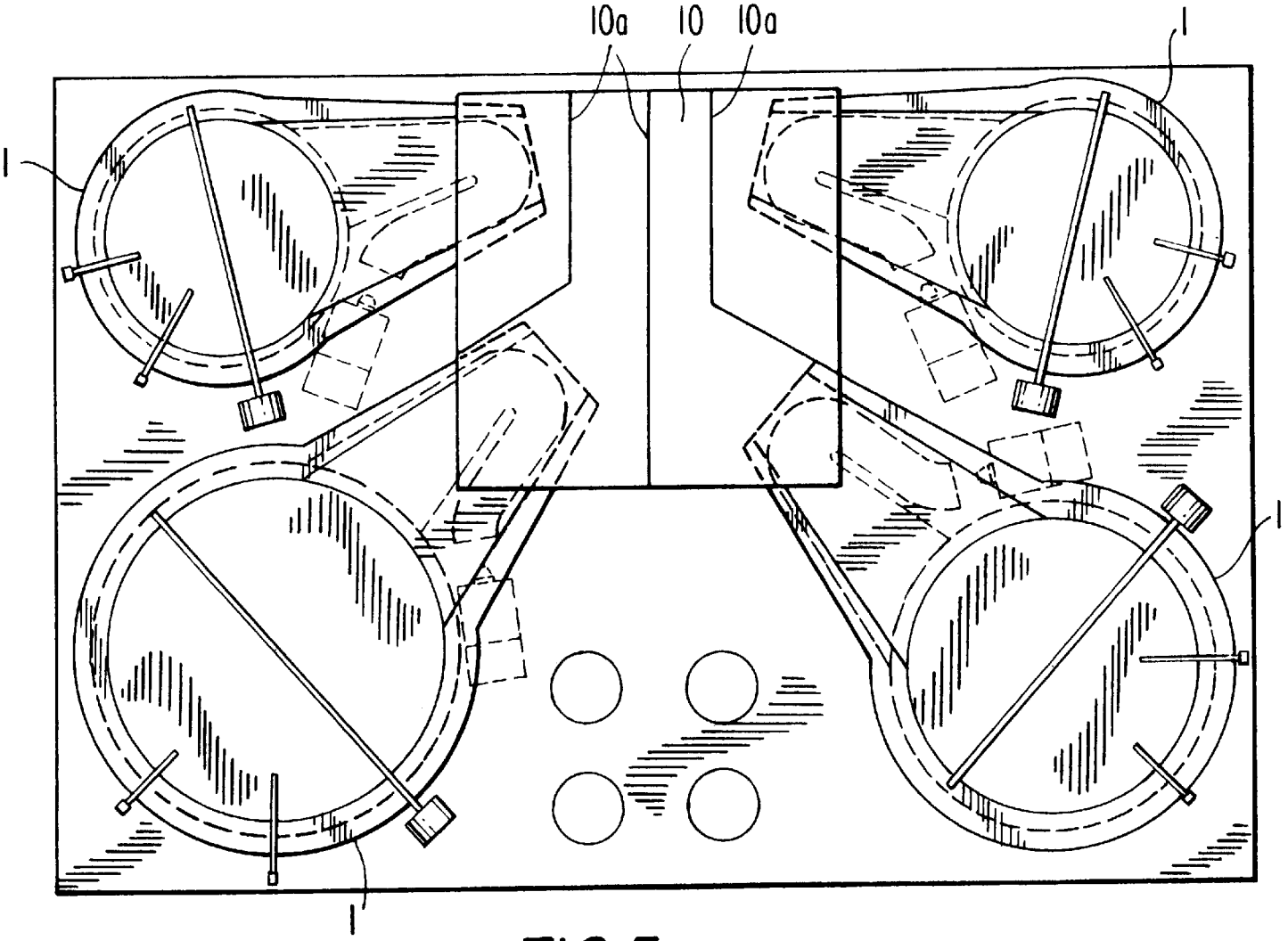
FIGS. 5 and 6 show top views of cook top arrangements with a different layout of the individual modules.

FIG. 5 shows schematically a plan view of a gas-fired cook top with four different burner modules 1 which can be arranged in nearly any desired manner. Such cook tops are of interest, for example, for the North American market.

Figure 6:
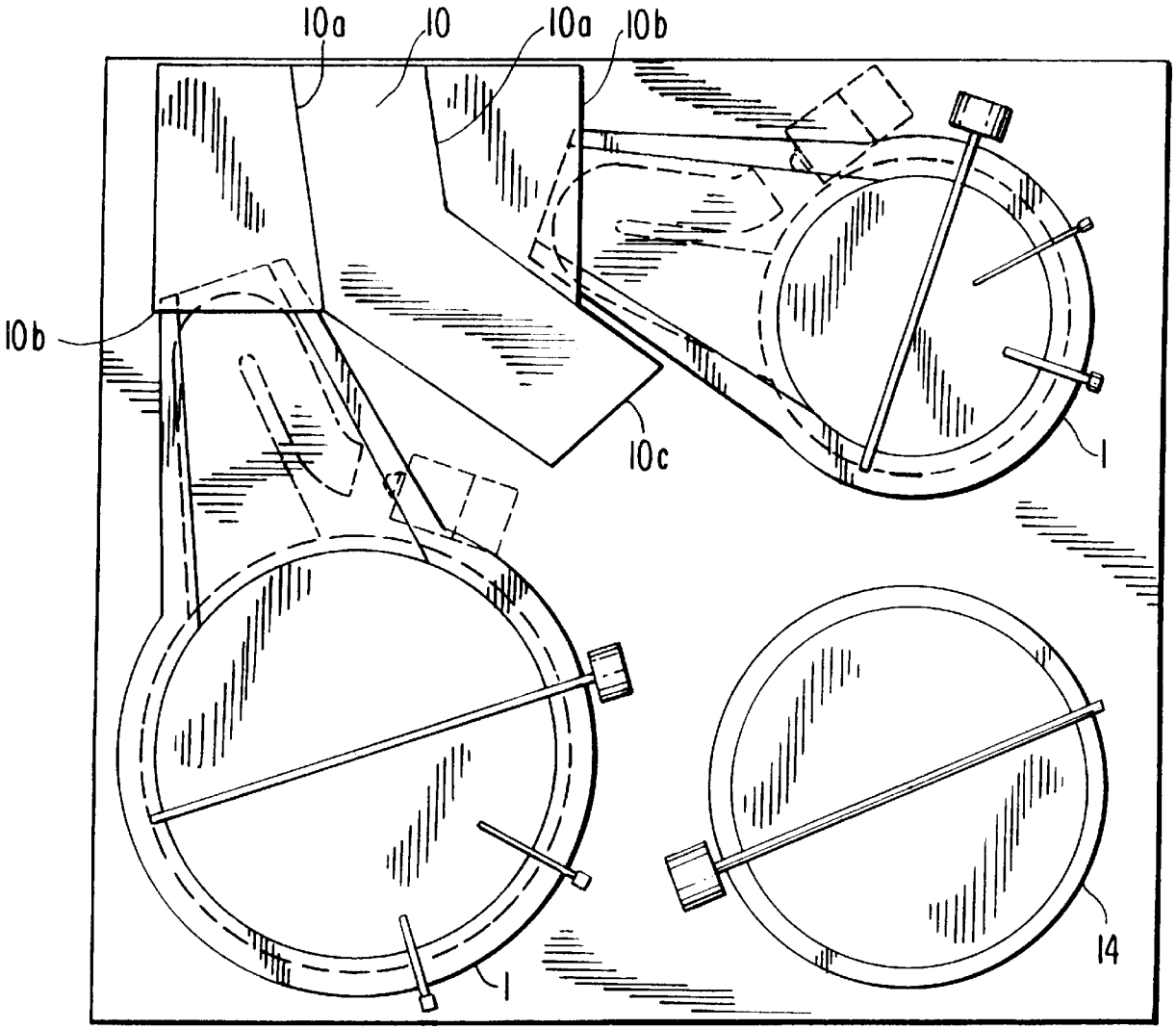

FIG. 6 shows schematically a plan view of a gas-fired cook top with two gas-fired burner modules 1 as well as one electrically heated radiant heating element 14 in combination. The one exhaust duct of the gas exhaust manifold is closed 10*c*. This embodiment is representative of other combinations of gas-fired radiant heat burners 1, gas-fired atmospheric burners (not shown here) and electrically heated radiant heating elements 14.

By the modular design according to the invention, a kind of modular system is made available for any combination of different heating systems for glass ceramic cook tops.

The embodiments shown above are representative of other embodiments, such as hexagonal or octagonal embodiments, which also can be combined modularly.

It will be understood that the specification and examples are illustrative but not limitative of the present invention and that other embodiments within the spirit and scope of the inventions will suggest themselves to those skilled in the art.

We claim:

1. A modularly constructed and variably configurable cook top arrangement comprising:

a frame:

at least two pre-formed individual assemblies, said individual assemblies having parts formed of metal to which thermal insulation is joined, the individual assemblies have a symmetrical geometric shape after their assembly to a functional unit;

fastening means whereby the at least two individual assemblies can be associated with one another and with the frame structure and can be joined releasably to form a single functional unit;

wherein the compact shape of the individual assemblies is achieved by a process selected from the group consisting of folding or shortening the mixer tube, said mixer tube comprising auxiliary gas mixing means.

2. The cook top arrangement of claim 1, wherein said at least two individual assemblies comprise at least one module selected from the group consisting of an exhaust component, burner unit, controlling module and signal and display unit operably connected to said individual assemblies, and further wherein said individual assemblies comprise a glass ceramic cook surface operably connected to said individual assemblies.

3. The cook top arrangement of claim 2, wherein said fastening means comprises a member selected from the group consisting of openings, bores, and cutouts.

4. The cook top arrangement of claim 3, wherein at least one said fastening means provides for leading in and fixation of said wiring, said ignition, said regulating system, said protective system and said indicating system.

5. The cook top arrangement of claim 1 wherein a plurality of operating functions are combined in a single assembly.

6. The cook top arrangement of claim 1 wherein the thermal insulation is formed of temperature-resistant fibers.

7. The cook top arrangement of claim 6 wherein the temperature-resistant fibers comprise $SiO_2$—$Al_2O_3$.

8. The cook top arrangement of claim 1 wherein the thermal insulation is formed of a microporous material.

9. The cook top arrangement of claim 8, wherein the thermal insulation is tightly bound mechanically to the shaped metal parts by at least one member selected from the group consisting of press-fit and bending tabs.

10. The cook top arrangement of claim 1 wherein the thermal insulation is tightly bound to the shaped metal parts by cementing.

11. The cook top arrangement of claim 1 wherein the thermal insulation comprises a bonded, solid ceramic fiber material which adheres continuously by bonding to the shaped metal part.

12. The cook top arrangement of claim 11, wherein the metal part is configured as a supporting, persistent sieve form for a thermal insulating layer to be prepared by the suction method as a sieve mesh.

13. The cook top arrangement of claim 12, wherein said metal part is configured as a perforated piece of sheet metal.

14. The cook top arrangement of claim 12, wherein said metal part is configured as a slitted piece of sheet metal.

15. The cook top arrangement of claim 1 wherein each of the individual assemblies have a compact symmetrical geometric shape.

16. The cook top arrangement of claim 1 wherein the thermal insulation is prepared by a process selected from the group consisting of a foaming method and a burn-out method.

17. The cook top arrangement of claim 16 wherein the thermal insulation is of a foamed material.

18. The cook top arrangement of claim 16 wherein the thermal insulation is made by a burnt-out method.

* * * * *